US006041202A

United States Patent [19]

Cornelius

[11] Patent Number: 6,041,202

[45] Date of Patent: Mar. 21, 2000

[54] SEAL FOR TONER CARTRIDGE

[76] Inventor: Lester Cornelius, 47-00 33rd St., Long Island City, N.Y. 11101

[21] Appl. No.: 09/347,722

[22] Filed: Jul. 6, 1999

Related U.S. Application Data

[60] Provisional application No. 60/091,226, Jul. 6, 1998.

[51] Int. Cl.[7] ..... G03G 15/08

[52] U.S. Cl. ..... 399/106; 222/541.1; 428/113; 428/149; 428/150; 428/151; 428/354; 428/381; 428/442

[58] Field of Search ..... 399/98, 102, 103, 399/105, 106; 222/DIG. 1, 541.1; 220/359.2, 359.3; 428/149–151, 113, 354, 442, 381

[56] References Cited

U.S. PATENT DOCUMENTS

| | | | |
|---|---|---|---|
| Re. 35,529 | 6/1997 | Michlin | 399/106 |
| 3,385,749 | 5/1968 | Hampshire | 428/113 |
| 3,783,089 | 1/1974 | Hurst et al. | 220/359.3 |
| 4,164,526 | 8/1979 | Clay et al. | 264/45.3 |
| 4,931,838 | 6/1990 | Ban et al. | 399/106 |
| 5,177,540 | 1/1993 | Honda et al. | 399/106 |
| 5,523,828 | 6/1996 | De Kesel | 399/103 |
| 5,621,508 | 4/1997 | McNamara | 399/106 |
| 5,733,625 | 3/1998 | Tsuchiya et al. | 428/113 |
| 5,752,131 | 5/1998 | Fujiwara et al. | 399/106 |
| 5,780,150 | 7/1998 | Block et al. | 428/354 X |
| 5,876,541 | 3/1999 | Chitouras | 399/106 X |
| 5,878,306 | 3/1999 | Michlin | 399/106 |
| 5,930,559 | 7/1999 | De Kesel | 399/106 |

*Primary Examiner*—Matthew S Smith
*Attorney, Agent, or Firm*—Charles E. Temko

[57] ABSTRACT

A frangible tear strip for toner cartridges used in electrophotographic copying devices, in which bursting strength is increased without making it more difficult for the user to longitudinally tear the strip to create an opening for passage of toner prior to use. This is accomplished by providing multiple areas of transverse reinforcement of the strip either by increased local area fusing of the material, or the lamination of transversely extending reinforcements at spaced intervals. In a preferred embodiment, the reenforcing material extends the entire axial length of the seal. In a further embodiment, the reinforcing material includes a layer of foam material having a rectangular opening overlapping a corresponding opening in a toner cartridge.

15 Claims, 3 Drawing Sheets

SEAL FOR TONER CARTRIDGE

RELATED APPLICATION

Reference is made to my copending provisional application Ser. No. 60/091,226 filed Jul. 6, 1998 under the title Seal For Toner Cartridge.

BACKGROUND OF THE INVENTION

This invention relates generally to the field of toner cartridges used in electro-photographic copying devices, and more particularly to an improved removable toner seal used to cover the elongated slot in the cartridge through which toner material flows during operation of the copier.

Various seal materials have been used to prevent toner from leaking out of the toner containment assembly, especially during shipping, prior to use of the toner cartridge. These materials have several requirements, including the ability to tear in a straight line, without tapering or reducing the width of the opening, and to be strong enough to prevent bursting of the seal material caused by the weight of the toner and a sudden impact, as could occur in shipping. The resulting unwanted bursting allows toner to leak from the cartridge.

Two common classes of seal materials are polyester and similar films, and ribbon materials, such as extruded polypropylene or extruded polyethylene. Ribbon materials are widely used in toner cartridges that are remanufactured. Such ribbon materials have suitable lengthwise or axial tensile strength, but the nature of the ribbon material is such that it is significantly weaker in a direction lateral to its principal axis, which is the tear direction. This weakness results in relatively low burst strength, but excellent pull-tear direction. The ribbon material is composed of fibers lightly fused together to form a continuous sheet of material. The fibers are fused in parallel alignment. This parallel arrangement creates a fault direction that allows tearing in a straight line.

In the prior art, to overcome the ribbon material weakness ninety degrees from the direction of the fiber alignment, it is known to apply a thin polyester lamination, to the ribbon material to increase its strength in the weak direction to prevent bursting, but this procedure also strengthens the seal in the tear direction. In so doing, the initial tear of the ribbon laminating strip is made more difficult, and if the laminating layer is too strong it overcomes the straight line tearing characteristic of the parallel ribbon fibers, which defeats the purpose of using the ribbon material. One solution for this problem is disclosed in U.S. Pat. No. 5,523,828, in which two small starting cuts are made parallel to the pull strip axis to provide easier tear starting, this being of particular importance with laminated material.

SUMMARY OF THE INVENTION

Briefly stated, the invention contemplates the provision of improved seals of the class described formed from ribbon or ribbon-like materials with essentially parallel nonwoven fibers which tear readily along the principal axis thereof In order to increase the bursting, i.e. transverse strength of the seal, and create a more controlled tear strip, certain areas of the ribbon material are formed to a higher degree of fusion, using heat, or through the application of adhesive backed laminating material in the form of reinforcing bands extending transversely of the axis of the strip. The former is employed in the case of heat fusible materials such as commonly used polypropylene or polyethylene. The latter is used in the case of non-fusible material in which case the laminating strips are adhesively attached using pressure sensitive, heat sensitive, and ultraviolet curing adhesives. There are many patterns which may be used to increase the strength of the seal in its transverse direction, depending upon the burst strength necessary for the particular cartridge assembly, and this, in turn, dependent upon the mass of the toner held by the seal, and the impact conditions that must be withstood. By causing more complete fusing of the film in a direction normal to the direction of tear, the inherent weakness of the material is overcome without loss of the formation of straight tear lines along the parallel fibers. In a preferred embodiment, additional laminating material is provided in the form of a complete strip extending the length of the seal, and laminated by heat sealing.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figure 1:
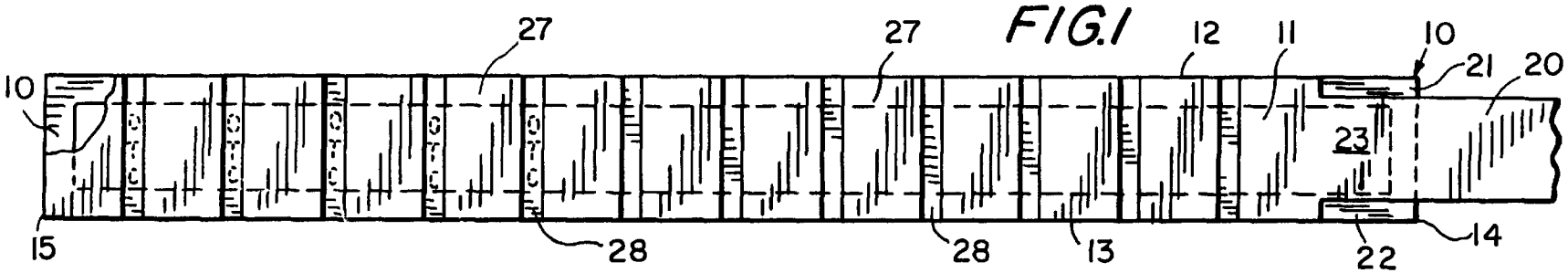
FIG. 1 is a plan view of a first embodiment of the invention.
Figure 2:
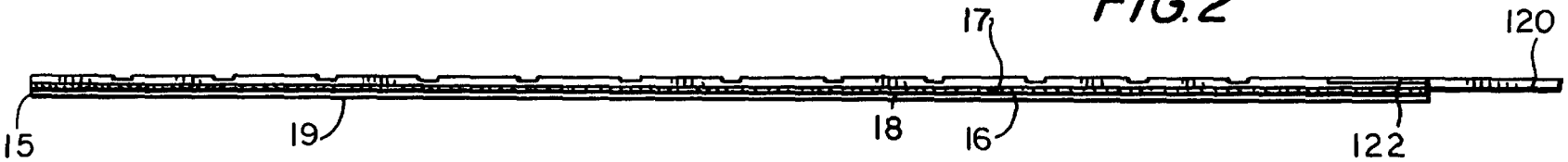
FIG. 2 is a side elevational view thereof.
Figure 3:
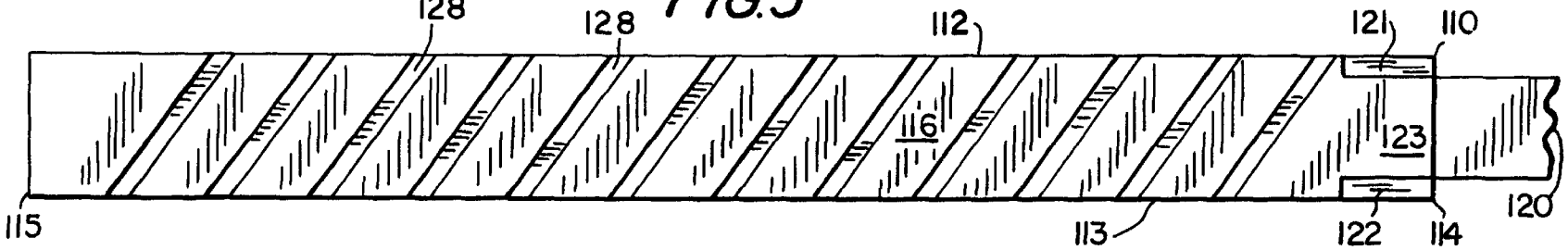
FIG. 3 is a plan view of a second embodiment of the invention.

In accordance with the first embodiment of the invention, generally indicated by reference character 10, it includes a strip of fibrous non-woven material 11 bounded by first and second longitudinal edges 12 and 13, a first or leading end 14, a second or trailing end 15, as well as first and second planar surfaces 16 and 17, respectively. The second surface 17 is coated with a layer of pressure sensitive adhesive 18 which enables the strip to be secured to cover the slotted opening in a toner cartridge (not shown) through which toner material passes. The adhesive 18 is initially protected by a protective cover strip 19 which is progressively removed as the seal is engaged in position to cover the slotted opening in the toner cartridge.

The leading end 14 includes a tear strip 20 and first and second longitudinally extending areas of increased fusion 21 and 22 adjacent the tear strip, to form a tear area 23 therebetween. The tear strip is of width corresponding to the tear area, so that when the strip 20 is manipulated, the strip will tear along two parallel lines adjacent the inner edges of the areas 21 and 22. In this manner, the need for pre-cutting or perforating this area to facilitate tearing is eliminated, along with the possibility that bursting can occur in this area because of weakening of the material caused by the cuts or perforations.

Located between substantially uniform intervals 27 are a plurality of transversely oriented areas 28 of increased fusion which serve to increase the lateral strength of the strip against bursting, without interfering with the ability of the strip to be torn in a direction parallel to the principal axis.

In the first embodiment, these areas or bands are oriented normally with respect to the principal axis, and may include, if desired, a cosmetic affect, such as a brand name, or other graphic design. The width and spacing of the reinforced areas are, of course, dependent upon the burst resistance desired, and the accompanying lateral weakness of the seal. The goal of placement and width of the bands is to use as few as necessary, and to make them as narrow as can be effective. A typical example would be two 5 mm. by 3 mm. bands along the edge of both sides of the tear strip, as discussed above, and a series of 3 mm. wide bands spaced at 12 mm. intervals along the length of the seal and oriented perpendicular to the side edges of the tear strip.

One generally accepted burst test is one in which a toner cartridge is dropped from a height of three feet on each of four sides, and then on two corners, for a total of six drops. The toner cartridge is then disassembled and inspected for leaks. A successful test is one in which no leakage of toner is found. An additional requirement is that the seal is relatively easy to remove and that it tears in a straight line and does not taper or veer off as it is pulled, creating an insufficient opening for the toner to exit. This second requirement has been met by the use of non-woven textile material which is known in the art.

Turning now to the second embodiment of the invention, parts corresponding to those of the first embodiment have been designated by similar reference characters with the additional prefix "1".

In the second embodiment, the areas 128 are disposed at an angle with respect to the normal, and may be placed so that they overlap each other at the ends thereof.

Turning now to the third embodiment of the invention, to avoid needless repetition, certain of the parts corresponding to the first embodiment have been designated by similar reference characters with the additional prefix "2".

The third embodiment differs from the first embodiment in the provision of an additional strip of oriented material 30 which is interconnected to the strip 211 by heat sea led transversely-extending areas 228 approximately 3 mm. wide, and spaced at substantially uniform intervals of 12 mm. The layer 30 extends from a transversely extending edge 31 to a second transversely extending edge 32, and is entirely torn by the tear strip 220 along with the strip 211 of which it forms an extension.

The lamination of the strip 211 and the strip 30 at frequent transverse intervals imparts a substantial rigidity to the seal in a transverse direction, but not along its longitudinal axis, thus making it possible to position the seal upon the slotted opening of the toner cartridge in a progressive manner starting at one end thereof once the protective strip 219 is remove d. By so doing, it is possible to accurately align the seal with the toner cartridge opening as adhesion progresses, and it is also possible to partially disconnect portions of the seal for re-alignment and reattachment if necessary.

Figure 4:
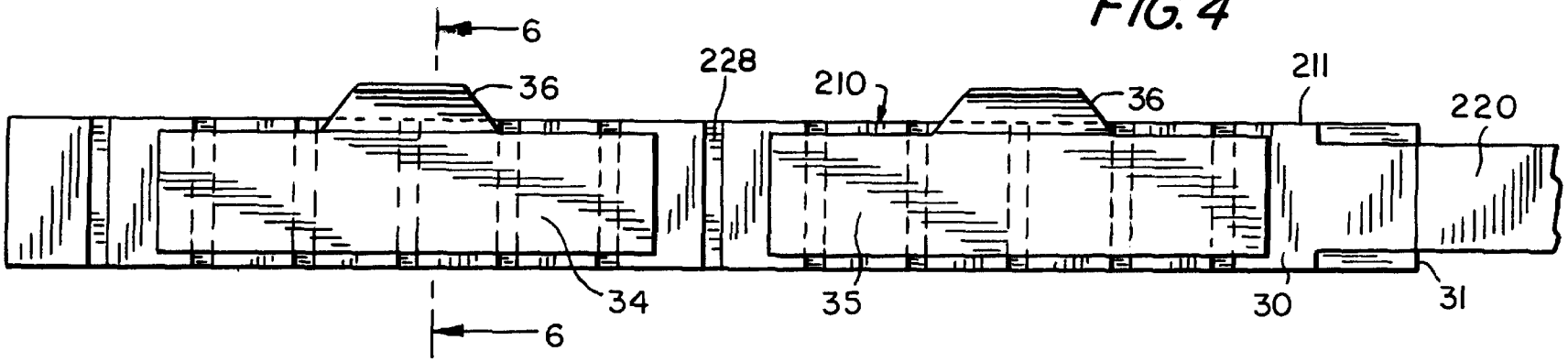
FIG. 4 is a plan view of a third embodiment of the invention.
Figure 5:
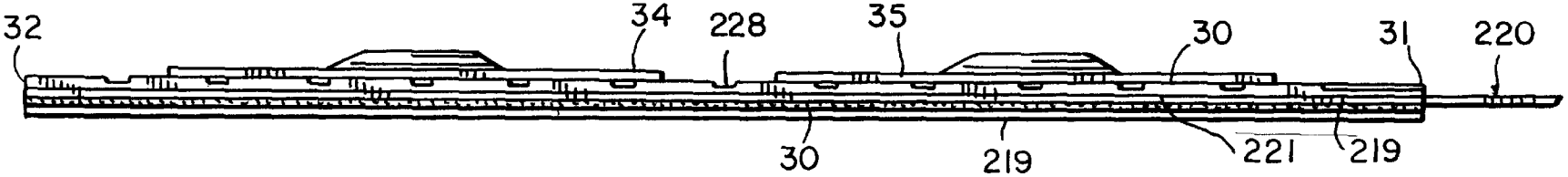
FIG. 5 is a side elevational view thereof.
Figure 6:
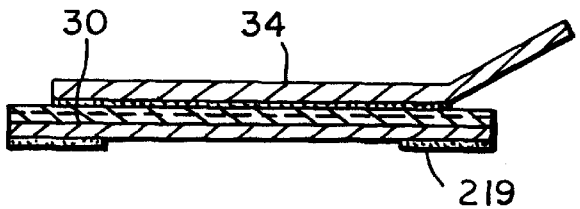
FIG. 6 is a transverse sectional view thereof as seen from the plane 6—6 in FIG. 4.

To make installation of the seal without the necessity of manually engaging the longitudinal end edge portions thereof which are adhesively coated on the lower surface, small attachment tabs 34 and 35 may be provided, each including a bent up portion 36 which is manually engageable by a user during installation. The tabs are temporarily attached to the exposed surface of the strip 30 by a pressure-sensitive material, and may be made of relatively thin paper stock, so as not to interfere with the flexibility of the seal along its principal axis. The tabs may also be formed of thin synthetic resinous material, including a vinyl component, in which event, a degree of adhesion may be obtained without the use of a pressure sensitive material. In either case, the tabs are serially removed as the seal is progressively adhered to the toner cartridge opening. In FIG. 4, the tabs are illustrated as two in number, but, if desired, they may be of greater number, and of shorter axial length.

Turning now to the fourth embodiment of the invention, parts corresponding to the first embodiment have been designated by similar reference characters with the additional prefix "3".

The fourth embodiment is particularly suited for use with larger toner cartridges having relatively larger slotted openings, and where the opening overlies another part of the cartridge, making installation somewhat more difficult. To accomplish this requires a seal of somewhat greater longitudinal rigidity which is provided by an additional apertured peripheral member of compressible material.

Figure 7:
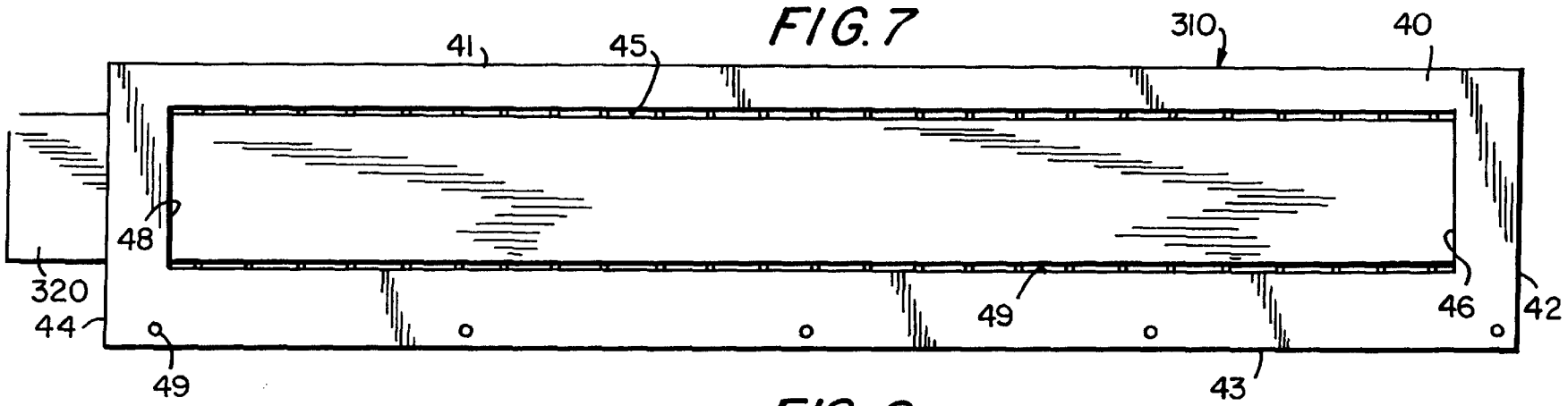
FIG. 7 is a top plan view of a fourth embodiment of the invention.
Figure 8:
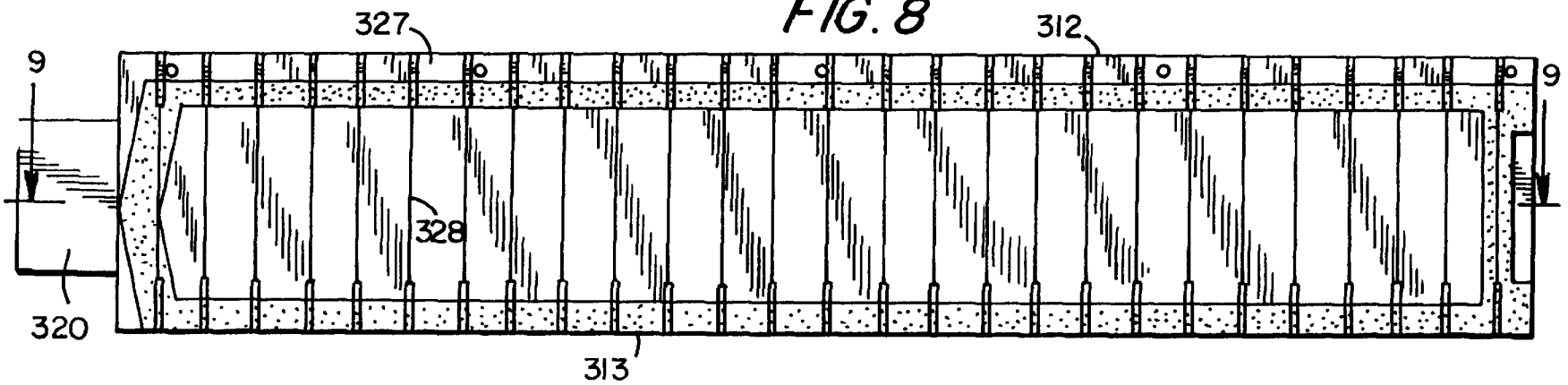
FIG. 8 is a bottom plan view thereof.
Figure 9:
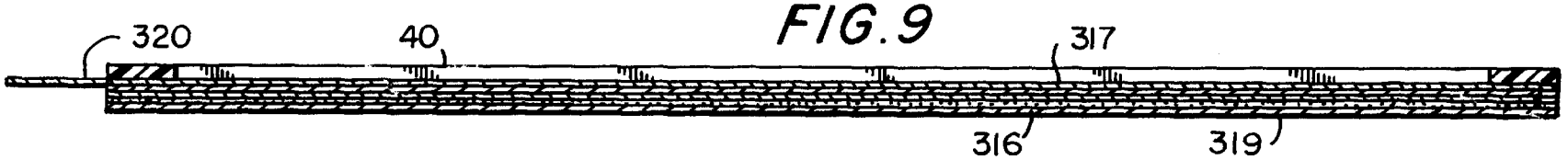
FIG. 9 is a longitudinal sectional view thereof as seen from the plane 9—9 in FIG. 8.

Referring to FIGS. 7, 8, and 9, there is illustrated a seal, generally indicated by reference character 310, which includes a foam lamina 40 which is co-extensive with the body of the seal and bonded thereto.

The purpose of the foam is to act as a sealing gasket between the toner hopper and either the printer/copier, or between the toner hopper and the attaching member called the developer assembly. This configuration is used in particular when a hoper must be sealed with these sections separated. They are assembled together after sealing by many means including adhesives, ultrasonic welding, and mechanical fasteners. Some toner hoppers are sealed and mounted directly into printers or copiers using tensioning methods where the foam gasket prevents toner leakage between the hopper and the printer/copier.

The lamina 40 includes peripheral edges 41, 42, 43, and 44, and defines a rectangular opening bounded by edges 45, 46, 47, and 48. The edge 41 may include a plurality of spaced through openings 49 which engage corresponding pins (not shown) on the toner cartridge after installation. The foam lamina, when laminated, adds additional strength to the seal in a lateral direction, and supplements the effect of the transversely-oriented areas 328. Because of the presence of the rectangular opening in the foam lamina 40, no additional tearing force is necessary when tearing the seal to open the same.

In the fourth embodiment, as with the first embodiment, the transversely-extending areas 328 may be so configured that the areas are wider, or more heavily fused at the terminal ends thereof commencing at the edges of the tear strip portion.

I wish it to be understood that I do not consider the invention to be limited to the precise details of structure illustrated and set forth in the specification, for obvious modifications will occur to those skilled in the art to which the invention pertains.

I claim:

1. A seal for toner cartridge used in electrophotographic devices comprising: an elongated strip of fibrous non-woven material having a principal longitudinal axis and having axially aligned fibers lightly fused together in a synthetic resinous film to have substantial tensile strength in an axial direction and relatively less strength in a direction normal to said principal axis; said strip including a leading end and a trailing end and being bounded by first and second longitudinal edges, and first and second surfaces; adhesive means on said second surface adapted to adhere to a toner cartridge to overlie a toner dispensing slot therein; said strip having transversely extending areas of relatively greater degree of fusion to increase a transverse burst strength thereof without affecting the ability to be torn in an axial direction from said leading end to said trailing end between said longitudinal edges.

2. A seal in accordance with claim 1, in which said transversely extending areas are fused to a higher level by application of heat to said areas.

3. A seal in accordance with claim 1, in which said transversely extending areas are formed by bands of laminated fibrous non-woven material in which the fibers are parallel to the fibers in said strip.

4. A seal in accordance with claim 3, in which said bands of material are laminated using any of pressure sensitive, heat activated and ultraviolet activated adhesives.

5. A seal in accordance with claim 1 further comprising: axially oriented first and second areas of increased fusion bordering said first and second longitudinal edges adjacent said leading end to define a starting point for a tear strip portion positioned therebetween.

6. A seal in accordance with claim 5, said tear strip portion having a free end initially positioned between said strip of fibrous non-woven material and said foam material.

7. A seal in accordance with claim 5, in which said transversely-extending areas have a lesser degree of fusion in portions thereof which form the tear strip portion.

8. A seal in accordance with claim 1, further comprising an axially-aligned tear strip and a laminated strip of foam material fused to said strip of fibrous non-woven material; said foam material having a generally rectilinear opening therethrough, said opening overlying said tear strip portion.

9. A seal for toner cartridges used in electrophotographic devices comprising a strip of fibrous non-woven material having a principal axis in which the fibers are axially aligned and lightly fused within a synthetic resinous film; said strip including transversely oriented areas of relatively greater fusion at periodic intervals along said principal axis.

10. A seal in accordance with claim 9, in which said areas of greater fusion are formed by application of heat.

11. A seal in accordance with claim 9, in which said areas of greater fusion are formed by lamination of additional fibrous material in which the fibers of this additional fibrous material are axially aligned parallel to the principal axis of said strip.

12. A seal in accordance with claim 11, in which lamination of sid additional fibrous material is formed using any of pressure sensitive, heat sensitive and ultraviolet sensitive adhesives.

13. A seal in accordance with claim 11, in which said additional fibrous material is in the form of a continuous strip extending substantially the entire length of said seal.

14. A seal in accordance with claim 13, in which said additional fibrous material is laminated by heat sealing along transversely-oriented areas approximately 3 mm. in width, and mutually spaced at intervals of approximately 12 mm., so as to substantially increase the stiffness of the seal in a direction perpendicular to the principal axis thereof, without affecting the flexibility of the seal along the principal axis thereof.

15. A seal in accordance with claim 13 in which said continuous strip includes an outer surface, and a plurality of manually engageable flexible tabs removably adhered to said outer surface enabling installation of said seal in a progressive manner from a first end to a second end without manually engaging longitudinal edges of said seal.

* * * * *